United States Patent [19]

Harpe

[11] Patent Number: 5,020,720

[45] Date of Patent: Jun. 4, 1991

[54] MAILBOX HOLDER

[76] Inventor: Joseph A. Harpe, 4680 Miller Rd., Buckley, Mich. 49620

[21] Appl. No.: 470,763

[22] Filed: Jan. 26, 1990

[51] Int. Cl.[5] ..... B65D 91/00

[52] U.S. Cl. ..... 232/39; 248/145

[58] Field of Search ..... 232/39, 17; 248/144, 248/145, 160; 404/10, 11

[56] References Cited

U.S. PATENT DOCUMENTS

| | | | |
|---|---|---|---|
| 2,550,338 | 4/1951 | Dungan | 232/39 X |
| 2,587,856 | 3/1952 | Jung | 248/145 |
| 2,936,143 | 5/1960 | Anderson | 248/145 |
| 4,172,579 | 10/1979 | Steinman | 248/145 |
| 4,852,847 | 8/1989 | Pagel | 248/145 X |
| 4,915,293 | 4/1990 | Paramski | 232/39 |

*Primary Examiner*—Robert W. Gibson, Jr.

*Attorney, Agent, or Firm*—Litman, McMahon & Brown

[57] ABSTRACT

A device for supporting a mailbox which is moveable to allow the mailbox and support arm to absorb and avoid the full force of contact from vehicles and other external sources. The mailbox is supported by a flexible horizontal member extending from a main, vertical member. Additional protection is afforded by a flange disposed under tension.

7 Claims, 2 Drawing Sheets

FIG. 2
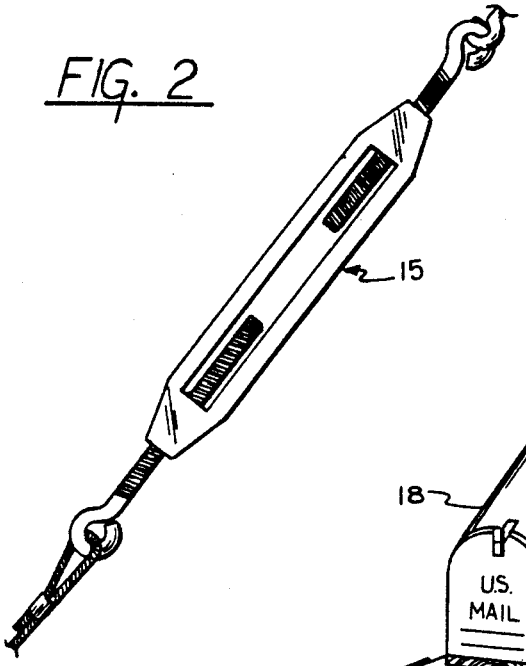
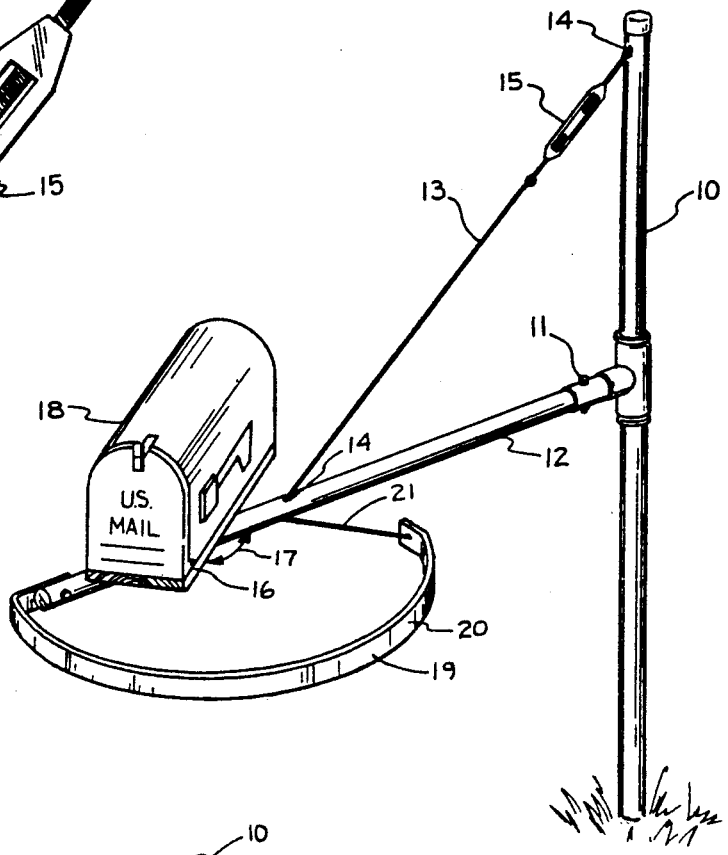
FIG. 1
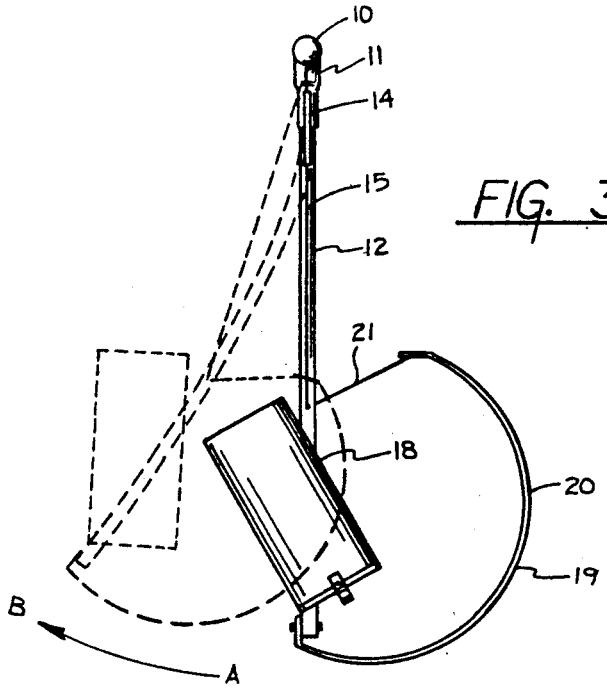
FIG. 3

MAILBOX HOLDER

BACKGROUND OF THE INVENTION

The use of a support arm which swings in a horizontal plane around a vertical support member to minimize impact damage to a mailbox is generally known. Illustrations of prior art setting forth such embodiments are Virblas U.S. Pat. No. 3,802,656; Steinman U.S. Pat. No. 4,172,576; Anderson U.S. Pat. No. 2,936,143; Hull U.S. Pat. No. 1,834,775; Chauncey U.S. Pat. No. 2,054,281; Conrad U.S. Pat. No. 2,433,763; Buck U.S. Pat. No. 2,605,073; and Dowker U.S. Pat. No. 4,187,978. Adaptations of this concept have included telescoping pipe joints providing a cam effect as in the Dowker patent and the Virblas patent; and a hinging mechanism attached to the vertical support member, as in the Buck patent.

Such existing devices essentially allow the horizontal support member to rotate about the primary vertical member. They, of necessity, have moving hinges, or joints, which are susceptible to corrosion, insertion of foreign matter and component failure. Further, these devices require some sort of incorporated gravity-activated cam action or an external, additional spring component to return the mailbox to its initial possession after any contact sufficient to activate the rotational feature. Additionally, the prior art generally provides for a horizontal, rotational, support arm which, when in its intended at-rest, functional position, is at right angles to the roadway and to the path of travel of vehicles, such as snowplows, whose contact with the mailbox causes the damage which these devices seek to eliminate or minimize.

The existing prior art fails to provide an apparatus which effectively reduces the potential for damage to the mailbox and support by vehicular contact and also provides for a return to the preferred initial position of the mailbox without manual assistance or without movable and external devices which are susceptible to breakage, corrosion or fouling by foreign material.

Accordingly, a need exists for a movable mailbox support which minimizes the damage effect of external contact and returns automatically to its intended position without the need for moving parts or external and superfluous return systems.

SUMMARY OF THE INVENTION

The present invention satisfies the need hereinbefore set forth by providing a mailbox support comprising a vertical support member with a support member extending horizontally therefrom. The support member is formed from a flexible resilient material and is further supported by a chain or cable extending from the top of the vertical member to the horizontal member at a point at or near the point where the mailbox is affixed. The horizontal support arm is positioned at approximately a 45 degree angle from a line extending at right angles from the roadway to the vertical member. Further protection is afforded to the mailbox by a steel flange, held under tension in a semi-circular radius around the actual mailbox support.

BRIEF DESCRIPTION OF THE DRAWINGS

Other objects, advantages and novel features of this invention will be set forth and will become apparent in the detailed description which follows and with reference to the accompanying drawings, in which FIG. 1 is a perspective view of the invention in actual operation;

FIG. 2 is a perspective view of the turnbuckle means for adjusting the tension in the supporting cable;

FIG. 3 is a top perspective view of the invention illustrating a range of motion of the flexible horizontal member from position A to position B (shown in phantom outline).

Figure 4:
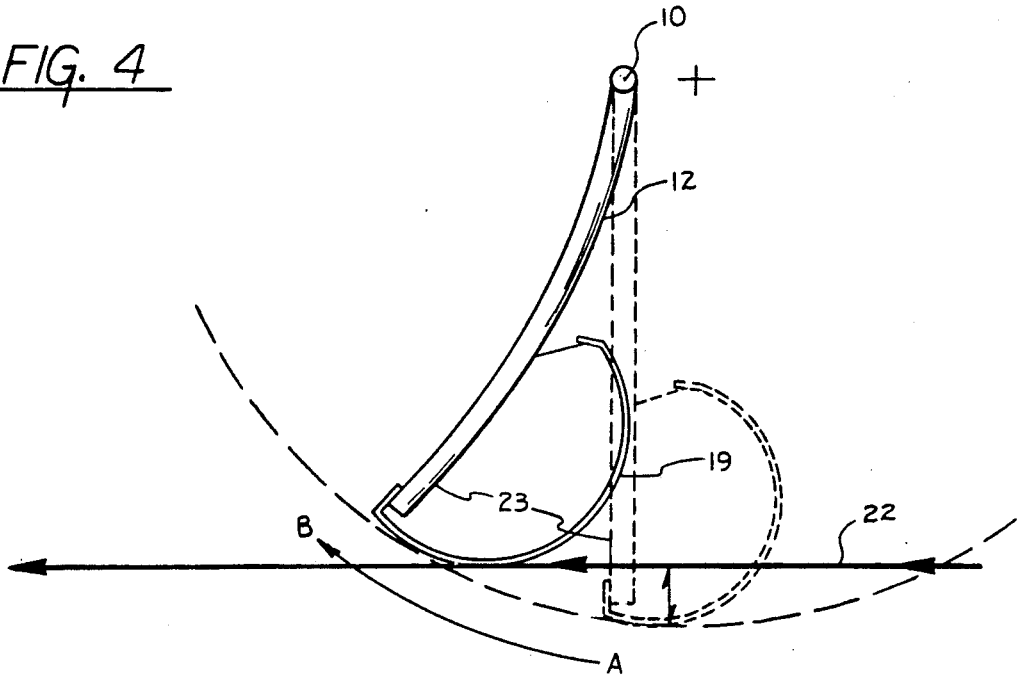
FIG. 4 is a top perspective view of the invention (without mailbox) illustrating the range of motion of the flexible horizontal member from position A {shown in phantom outline) to position B necessary to move the mailbox and holder out of the path of an object striking the invention when the flexible horizontal member is positioned at right angles to the roadway.

A preferred form of the invention is shown by reference to the drawings in particular.

DETAILED DESCRIPTION OF THE INVENTION

The mailbox holder comprises a primary vertical member 10, of a height in excess of the normal distance above ground level for mailbox placement. Extending horizontally from the primary vertical member 10 is a relatively short hollow cylindrical member 11, at the normal distance above ground for mailbox placement. A flexible cylindrical member 12 of smaller diameter is affixed within the larger diameter cylindrical member and extends horizontally outward therefrom. Additional support for the flexible horizontal member 12 is provided by a cable or chain 13 affixed by clamps or other means 14 at or near the top of the primarily vertical member 10 and at or near the point of mailbox placement on the flexible horizontal member 12. The tension in said cable or chain is adjustable by a turnbuckle means 15. Located on the horizontal flexible member 12 outwardly of the point where the cable or chain 13 is affixed is a horizontal planar surface 16, preferably in rectangular form. Said planar surface 16 is aligned on the horizontal flexible member 12, at an angle 17 therefrom, sufficient to align the mailbox at right angles from the roadway. A standard mailbox 18 is mounted upon the horizontal planar surface 16 and affixed by bolts or other means. Affixed to the end of the flexible horizontal member 12 is a resilient flange 19 of spring steel or other matter capable of being bent and held under tension. Said flange 19 is aligned to form an externally convex protective bumper 20 held under tension by a bolt, or other means 21 located inwardly of the planar surface 16 on the flexible horizontal member 12. Said protective bumper will normally be turned on the side of the mailbox support which faces oncoming traffic.

Figure 5:
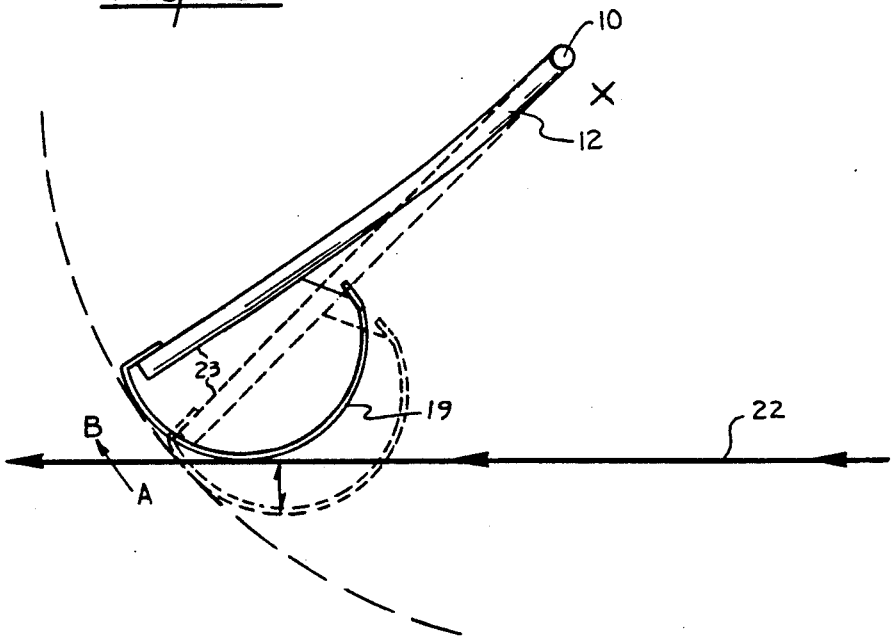
FIG. 5 is a top perspective view of the invention (without mailbox) illustrating the range of motion of the flexible horizontal member from position A (shown in phantom outline) to position B necessary to move the mailbox and holder out of the path of an object striking the invention when the flexible horizontal member is positioned at a 45 degree angle from the roadway.

In the preferred embodiment of the invention as shown in FIG. 1, the device is mounted so as to place the flexible horizontal member 12 at approximately a 45 degree angle from a line perpendicular to the roadway and flow of traffic 22, as shown in FIG. 5. Such placement greatly lessens the force of initial impact and requires a lesser amount of movement 23 of the flexible member 12 than does a placement wherein the flexible member 12 is perpendicular to the roadway 22, as shown in FIG. 4.

In a further embodiment of the invention the flexible horizontal member 12 is constructed of plastic conduit pipe.

While the best made and preferred embodiments of the invention have been presented and described in detail. It should be clearly understood that the invention is not limited thereto or thereby, and that various changes, adaptations and modifications may be made thereto and therein without departing from the spirit of the invention and the scope of the following claims.

What is claimed is:

1. An impactable mailbox support device comprising:

a vertical support post fixedly mountable in the ground;

a resilient, horizontal support member having a first end fixedly mounted on said support post, and terminating in a free second end; and a mailbox support surface mounted on said horizontal support member proximate the free end thereof, wherein, when an object strikes the mailbox support device or a mailbox mounted thereon, the resilient support member deflects out of the path of said moving object.

2. The device of claim 1 further comprising a support cable mounted at a first end thereof to said post and spaced above said support member and at a second end thereof to said support member adjacent said support surface.

3. The device of claim 1 further comprising a resilient, semi-circular flange having a first end mounted to the free end of the horizontal support member and a second end tensionably mounted to said horizontal support member medial of said support surface and said post so as to partially encircle said support surface.

4. The device of claim 1 wherein the support member defines a first horizontal axis extending longitudinally therethrough and the support surface defines a second horizontal axis extending longitudinally therethrough, said second axis being angularly offset with respect to said first axis such that, when said post is mounted in the ground adjacent a roadway such that said first axis is disposed at an approximately 45 degree angle with respect to the roadway, a mailbox mounted on said support surface is aligned at a right angle with respect to said roadway.

5. The invention of claim 3, wherein said cable may be adjusted by a turn buckle means.

6. The invention of claim 2, wherein the resilient horizontal support member is formed of plastic conduit pipe.

7. A method of aligning a mailbox support device with respect to an adjacent roadway comprising the steps of:

providing an impactable mailbox support device including:

a vertical support post fixably mountable in the ground;

a resilient horizontal support member having a first end fixedly mounted on said support post and terminating in a second free end, said support member defining a first horizontal axis extending longitudinally therethrough; and a mailbox support surface mounted on said horizontal support member proximate the free end thereof, said support member defining a second horizontal axis extending longitudinally therethrough, said second axis being angularly offset with respect to said first axis; and mounting said post in the ground adjacent said roadway such that said first horizontal axis is disposed at an approximately 45 degree angle with respect to the roadway so that a mailbox mounted on said support surface is aligned at a right angle with respect to said roadway.

* * * * *